US011999389B2

(12) United States Patent
Kroiss et al.

(10) Patent No.: US 11,999,389 B2
(45) Date of Patent: Jun. 4, 2024

(54) COUPLING SUPPORT FOR A CENTRAL BUFFER COUPLING OF A RAIL VEHICLE

(71) Applicant: Siemens Mobility GmbH, Munich (DE)

(72) Inventors: Manuel Kroiss, Ebersbach (DE); Hannes Peer, Munich (DE); Alexander Trachtenherz, Munich (DE)

(73) Assignee: Siemens Mobility GmbH, Munich (DE)

( * ) Notice: Subject to any disclaimer, the term of this patent is extended or adjusted under 35 U.S.C. 154(b) by 795 days.

(21) Appl. No.: 17/264,926

(22) PCT Filed: Jul. 18, 2019

(86) PCT No.: PCT/EP2019/069337
§ 371 (c)(1),
(2) Date: Feb. 1, 2021

(87) PCT Pub. No.: WO2020/025335
PCT Pub. Date: Feb. 6, 2020

(65) Prior Publication Data

US 2021/0323587 A1 Oct. 21, 2021

(30) Foreign Application Priority Data

Jul. 30, 2018 (DE) ..... 102018212688.7

(51) Int. Cl.
*B61G 7/10* (2006.01)
*B61G 1/22* (2006.01)
(Continued)

(52) U.S. Cl.
CPC ..... *B61G 7/10* (2013.01); *B61G 1/22* (2013.01); *B61G 1/28* (2013.01); *B61G 1/32* (2013.01);
(Continued)

(58) Field of Classification Search
CPC ... B61G 7/10; B61G 7/12; B61G 7/06; B61G 7/08; B61G 1/22; B61G 1/28; B61G 1/32; B61G 11/04; B61G 5/02; B61G 5/04
(Continued)

(56) References Cited

U.S. PATENT DOCUMENTS 2,504,892 A * 4/1950 Sisson ..... B61G 7/10 267/4
2,529,626 A * 11/1950 Nystrom ..... B61G 7/10 213/21
1,993,712 A * 3/1953 Barrows ..... B61G 7/10 213/21
4,032,017 A * 6/1977 Larsen ..... B61G 7/12 248/297.31
(Continued)

FOREIGN PATENT DOCUMENTS

DE 202014001334 U1 3/2014
GB 875216 A 8/1961
(Continued)

*Primary Examiner* — S. Joseph Morano
*Assistant Examiner* — James William Jones
(74) *Attorney, Agent, or Firm* — Laurence A. Greenberg; Werner H. Stemer; Ralph E. Locher

(57) ABSTRACT

A coupling support for a central buffer coupling of a rail vehicle includes first and second holding plates to be secured to the body of the rail vehicle. The coupling support has a base plate and a transverse bar disposed between the holding plates. The transverse bar is resiliently coupled to the base plate and is disposed above the base plate. First and second pivot levers are disposed on the base plate such that the pivot location of each pivot lever is disposed below the transverse bar, and the pivot locations are connected to the base plate. Each upper portion of the pivot levers is connected to the transverse bar by an articulated connection such that a movement of the transverse bar away from the base plate is restricted by the articulated connections and a movement of the transverse bar towards the base is allowed by the articulated connections.

6 Claims, 5 Drawing Sheets

(51) Int. Cl.

| | |
|---|---|
| ***B61G 1/28*** | (2006.01) |
| ***B61G 1/32*** | (2006.01) |
| ***B61G 7/06*** | (2006.01) |
| ***B61G 7/08*** | (2006.01) |
| ***B61G 7/12*** | (2006.01) |
| *B61G 5/02* | (2006.01) |
| *B61G 5/04* | (2006.01) |
| *B61G 11/04* | (2006.01) |

(52) U.S. Cl.
CPC ..... *B61G 7/06* (2013.01); *B61G 7/08* (2013.01); *B61G 7/12* (2013.01); *B61G 5/02* (2013.01); *B61G 5/04* (2013.01); *B61G 11/04* (2013.01)

(58) Field of Classification Search
USPC ..... 213/9
See application file for complete search history.

(56) References Cited

U.S. PATENT DOCUMENTS

| | | | | |
|---|---|---|---|---|
| 4,674,639 | A * | 6/1987 | Kaim | B61G 7/10 213/62 R |
| 6,321,922 | B1 | 11/2001 | Rumsey et al. | |
| 8,783,479 | B2 | 7/2014 | Ewerding | |
| 10,589,761 | B2 | 3/2020 | Kroiss et al. | |
| 2009/0212000 | A1 * | 8/2009 | Kontetzki | B61G 7/12 213/61 |
| 2013/0048589 | A1 | 2/2013 | Schipmann | |

FOREIGN PATENT DOCUMENTS

| | | | | |
|---|---|---|---|---|
| GB | 952058 | A | 3/1964 | |
| RU | 2415043 | C2 | 3/2011 | |
| WO | WO-2016146170 | A1 * | 9/2016 | B61G 7/10 |
| WO | WO 2016146170 | A1 | 9/2016 | |

* cited by examiner

COUPLING SUPPORT FOR A CENTRAL BUFFER COUPLING OF A RAIL VEHICLE

BACKGROUND OF THE INVENTION

Field of the Invention

The invention relates to a coupling support for a central buffer coupling of a rail vehicle, wherein the coupling support is particularly suitable for a locomotive. The coupling support comprises a first retaining plate and a second retaining plate, by means of which the coupling support can be fixed to a vehicle body of the rail vehicle. The coupling support further comprises a base plate which is arranged between the retaining plates and a transverse bar which is arranged between the retaining plates and which is arranged above the base plate and which is coupled to the base plate resiliently. The transverse bar can be used to support a coupling shaft of a central buffer coupling, wherein the central buffer coupling has a coupling shaft which is articulated to the vehicle body and which carries a coupling head.

The invention further relates to a central buffer coupling and a rail vehicle, in particular a locomotive, which each contain such a coupling support.

In this case, the transverse bar serves to adjust a specific height of the coupling head. For coupling two central buffer couplings, the coupling heads have to be arranged at a mutually corresponding height so that the couplings can engage in each other. During travel over a hump, the coupling shaft would now result in high forces on the transverse bar because the coupled couplings during such travel would be arranged in a lower position relative to the vehicles than during travel over a level substrate. As a result of the resilient arrangement of the transverse bar, it is possible for the coupling shaft to be able to press the transverse bar downward. To this end, the transverse bar must be movable to a given extent, on the one hand, but, on the other hand, be generally arranged so as to be fixed at its position between the retaining plates.

In the publication WO 2016/146170 A1, the transverse bar is fixed in that the transverse bar has guide grooves, in which the retaining plates engage in a positive-locking manner. The transverse bar is thereby movable in a resilient direction and guided laterally relative thereto. During travel of the rail vehicle round bends, the central buffer coupling or the coupling shaft of the central buffer coupling applies a lateral force to the transverse bar. At the same time, travelling over a hump or through a dip leads to the transverse bar moving in the resilient direction. Both together leads to friction at the guide grooves or the retaining plates. There can be provided vertical stops with which a height of the transverse bar can be adjusted.

The publication GB 875 216 A discloses a towing vehicle for rail vehicles, in which a towing vehicle drawbar which can be angled vertically and horizontally is supported on a box-shaped carrier element spring.

SUMMARY OF THE INVENTION

An object of the invention is to allow a movement of the transverse bar in the resilient direction and to minimize the friction, wherein in particular a relative movement between the transverse bar and vertical stops is intended to be minimized or prevented. Additional costs in terms of maintenance and repair can thereby be reduced or avoided without having to accept additional costs in terms of production and assembly.

This object is achieved by a coupling support for a central buffer coupling of a rail vehicle of the type mentioned in the introduction having the features set out in the characterizing portion of patent claim 1. Accordingly, the coupling support has a first pivot lever and a second pivot lever which are arranged on the base plate. A first pivot location of the first pivot lever is arranged under the transverse bar, a second pivot location of the second pivot lever is also arranged under the transverse bar. The first pivot location and the second pivot location are connected to the base plate. A first upper portion of the first pivot lever is connected by means of an articulated connection to the transverse bar. A second upper portion of the second pivot lever is connected to the transverse bar by means of a second articulated connection.

These connections are configured in such a manner that a movement of the transverse bar away from the base plate is limited as a result of the articulated connections and a movement of the transverse bar toward the base plate is possible as a result of the articulated connections.

The high-friction horizontal relative movement of the transverse bar relative to the previous vertical stops is therefore replaced by a substantially or completely frictionless rotational movement of the pivot levers, wherein the vertical stop can also move with the transverse bars as a result of the articulated connections which can also result in a vertical stop. Furthermore, horizontal redirections of a coupling shaft which is supported on the transverse bar cannot result in a vertical redirection of the transverse bar as a result of this construction.

As a result of the reduced friction between the transverse bar and the vertical stops, the service-life of the used components is increased, whereby the maintenance and repair costs can be reduced.

A pivot lever in the sense of the present invention is an element which is supported rotatably about an axis at a location and which otherwise cannot be further moved at this location. This location, at which the pivot lever is rotatably supported, constitutes the first pivot location of the first pivot lever or the second pivot location of the second pivot lever. The first pivot lever and the second pivot lever are therefore rotatable about the first pivot location or the second pivot location but otherwise non-movable with respect to the base plate. As a result of the articulated connections, by means of which the upper portions of the pivot levers are connected to the transverse bar, a movement of the transverse bar toward the base plate is allowed and a movement away from the base plate is limited. The transverse bar can thereby be fixed adequately between the retaining plates, on the one hand, and, on the other hand, can be moved toward the base plate, for example, during travel of the rail vehicle over a hump.

As a result of the proposed fixing of the transverse bar by means of pivot levers and articulated connections, the transverse bar can be moved in the resilient direction in a substantially easier manner because, as a result of the rotatable bearing of the pivot levers in the pivot location and the bearing as a result of the articulated connections, substantially less friction occurs. This further leads to a substantially reduced material wear and thereby to substantially less maintenance expenditure.

In an embodiment, the articulated connections each form a vertical stop of the transverse bar.

In an embodiment, a spring is arranged between the base plate and the transverse bar. Alternatively, more than one spring can also be arranged. There may be provision for the movement of the transverse bar away from the base plate to result in relaxation of the spring and for the movement of the transverse bar toward the base plate to result in tensioning of the spring. This is particularly the case when the spring is provided with a pretensioning between the base plate and the transverse bar. The pretensioning can be configured in such a manner that the transverse bar is pressed into an upper position as a result of the pretensioning, wherein the upper position is defined by the limitation of the movement of the transverse bar as a result of the articulated connections. The transverse bar can therefore be moved toward the base plate by accepting an additional tensioning of the spring, but not beyond the upper position further away from the base plate. This results in a coupling support which is suitable for a central buffer coupling.

In an embodiment, a pretensioning of the spring is adjustable, wherein the upper position of the transverse bar can thereby also be adjusted. This can be used to adapt the height of the central buffer coupling to different heights which are necessary as a result of different operating states.

In an embodiment, the first articulated connection has a bolt which is guided in an elongate hole. In this case, a movement of the transverse bar away from the base plate is limited by the elongate hole because the bolt strikes a stop of the elongate hole at a specific location. A movement of the transverse bar toward the base plate is allowed as a result of the structure of the elongate hole.

In an embodiment, the elongate hole is arranged on the transverse bar and the bolt is arranged on the first pivot lever. This allows the pivot lever to be able to be produced in a simple manner because it has to have only one bolt for positioning inside the elongate hole in addition to the articulation to the pivot location.

In an embodiment, the elongate hole is arranged on the first pivot lever and the bolt is arranged on the transverse bar. This advantageously results in a compact arrangement of the pivot lever and the transverse bar. In this case, an end of the elongate hole of the first pivot lever, which end is facing away from the first pivot location, can act as a stop in order to limit a movement of the transverse bar further upward as a result of the bolt.

In an embodiment, the first pivot lever has an adjustable vertical stop. An available length of the elongate hole can be changed by the adjustable vertical stop. A different pretensioning of the springs and a position of the transverse bar can thereby be advantageously adjusted.

In an embodiment, the first pivot lever has a threaded rod. The threaded rod is guided by an opening of the transverse bar. A nut above the opening is fitted to the threaded rod in such a manner that the threaded rod, the opening and the nut form the first articulated connection. By changing the position of the nut, the pretensioning of the springs or the position of the transverse bar can also be adjusted in this case.

In an embodiment, the nut has a thread protection, wherein the thread protection has an inner thread which corresponds to the threaded rod and is guided by the opening. Damage to the threaded rod resulting from a movement of the first articulated connection can thereby be advantageously prevented.

In an embodiment, the first pivot lever has a threaded rod. A ball joint is connected to the transverse bar and forms the first articulated connection. In this case, the ball joint is movable along the threaded rod, wherein the movement of the transverse bar away from the base plate is limited as a result of a nut which is arranged on the threaded rod. The ball joint allows a particularly frictionlessly operating first articulated connection.

In this embodiment, there may also be provision for the nut to have a thread protection, wherein the thread protection has an inner thread which corresponds to the threaded rod and is guided by the ball joint.

In the embodiments in which the transverse bar is fixed with a nut, there may be provision for fixing the nut with a counter-nut.

This allows secure adjustment of the position of the transverse bar.

In an embodiment, the transverse bar has a sliding plate which is arranged at a side of the transverse bar which faces away from the base plate. The coupling shaft of a central buffer coupling can be moved along this sliding face.

In an embodiment, the retaining plates each have a desired breaking location. This can be used to improve the crash safety of the central buffer coupling.

In all the embodiments, the second pivot lever and the second articulated connection can be configured similarly to the first pivot lever and the first articulated connection. Alternatively, it is possible to configure the first articulated connection and the second articulated connection in different embodiments. The first articulated connection may be configured, for example, as an elongate hole with bolts while the second articulated connection comprises a threaded rod, opening and nut. In this instance, any combinations of the embodiments mentioned are possible and conceivable.

The invention further comprises a central buffer coupling having one of the coupling supports mentioned. The central buffer coupling further has a coupling shaft and a coupling head which is arranged on the coupling shaft. The coupling shaft can be articulated to a vehicle body of the rail vehicle. The coupling shaft is supported by the transverse bar of the coupling support.

The invention further comprises a rail vehicle having a coupling support according to one of the embodiments mentioned, wherein the coupling support is fixed to the rail vehicle by means of the retaining plates. In addition, the rail vehicle may have a central buffer coupling which is also fixed to the rail vehicle and which has a coupling shaft and a coupling head which is arranged on the coupling shaft, wherein the coupling shaft can be supported by the transverse bar of the coupling support.

The above-described properties, features and advantages of this invention and the manner in which they are achieved will become clearer and more readily comprehensible from the explanation of the following, highly simplified schematic illustrations of preferred embodiments.

DETAILED DESCRIPTION OF THE INVENTION

Figure 1:
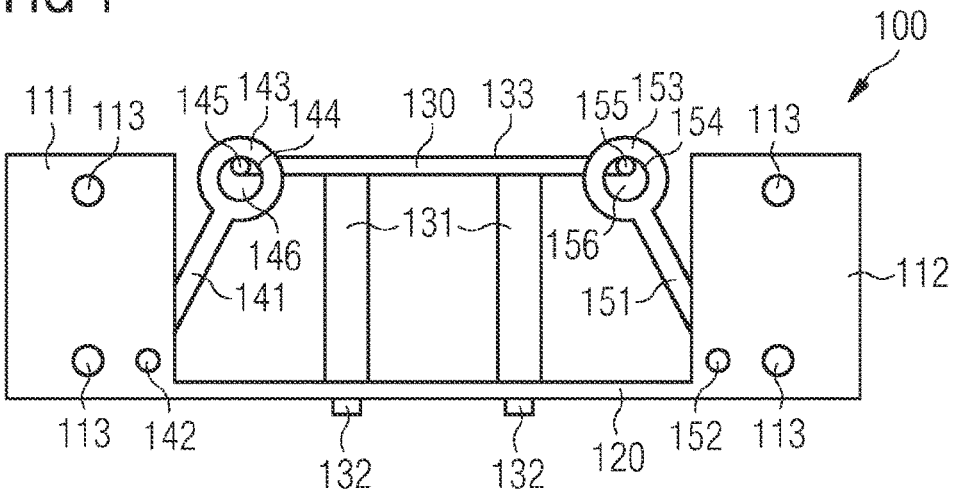
FIG. 1 shows a coupling support.

FIG. 1 is a plan view of a coupling support 100 for a central buffer coupling of a rail vehicle. The coupling support 100 has a first retaining plate 111 and a second retaining plate 112. The retaining plates 111, 112 can be fixed to a vehicle body of a rail vehicle. To this end, the retaining plates 111, 112 have fixing holes 113, by means of which the retaining plates 111, 112 can be screwed to the vehicle body. Alternatively, the retaining plates 111, 112 can be welded to the vehicle body or fixed in another manner. A base plate 120 is arranged between the retaining plates 111, 112. Furthermore, a transverse bar 130 is arranged between the retaining plates 111, 112, wherein the transverse bar 130 is resiliently connected to the base plate 120 and is arranged above the base plate 120. The resilient coupling can be produced by means of resilient elements 131, wherein the resilient elements 131 may be helical springs between the base plate 120 and the transverse bar 130.

Optional resilient tension elements 132, by means of which a pretensioning of the resilient elements 131 can be adjusted, are arranged under the base plate 120.

A first pivot lever 141 is arranged adjacent to the first retaining plate 111. A first pivot location 142 of the first pivot lever 141 is arranged under the transverse bar 130 in the region of the transition from the first retaining plate 111 to the base plate 120. A second pivot lever 151 is also arranged on the base plate 120 in a region between the base plate 120 and the second retaining plate 112 at a second pivot location 152. The first pivot lever 141 is rotatable about the first pivot location 142, the second pivot lever 151 is rotatable about the second pivot location 152. Apart from these rotational movements, the pivot levers 141, 151 are not movable with respect to the base plate 120. A first upper portion 143 of the first pivot lever 141 is connected to the transverse bar 130 by means of a first articulated connection 144. A second upper portion 153 of the second pivot lever 151 is connected to the transverse bar 130 by means of a second articulated connection 154. The articulated connections 144, 154 are configured in such a manner that a movement of the transverse bar 130 away from the base plate 120 is limited as a result of the articulated connections 144, 154. A movement of the transverse bar 130 toward the base plate 120 is possible as a result of the articulated connections 144, 154.

A central buffer coupling which can also be fixed to the rail vehicle may have a coupling shaft and a coupling head. In this case, the coupling shaft can be supported on the transverse bar 130 of the coupling support 100 and be carried by the transverse bar 130 of the coupling support 100. In this case, the coupling shaft can be moved to the left and right on the transverse bar 130, can lift off the transverse bar 130 during a movement upward away from the base plate 120 and can press the transverse bar 130 in the direction of the base plate 120 during a movement toward the base plate 120 in such a manner that the resilient elements 131 are further tensioned and the transverse bar 130 is moved in the direction of the base plate 120. The articulated connections 144, 154 are configured as bolts 145, 155 which are fixed to the transverse bar 130 in this case, wherein the bolts 145, 155 are guided by round openings 146, 156 of the pivot levers 141, 151.

In an embodiment, the resilient elements 131 are configured as springs, in particular as helical springs. In an embodiment, a movement of the transverse bar 130 away from the base plate 120 leads to a relaxation of the resilient elements 131 and a movement of the transverse bar 130 toward the base plate 120 leads to a tensioning of the resilient elements 131. The extent of the tensioning and relaxation of the resilient elements 131 can be preset via the optional resilient tensioning elements 132 in this case.

In this case, the articulated connections 144, 154 can be configured as a vertical stop of the transverse bar 130.

Figure 2:
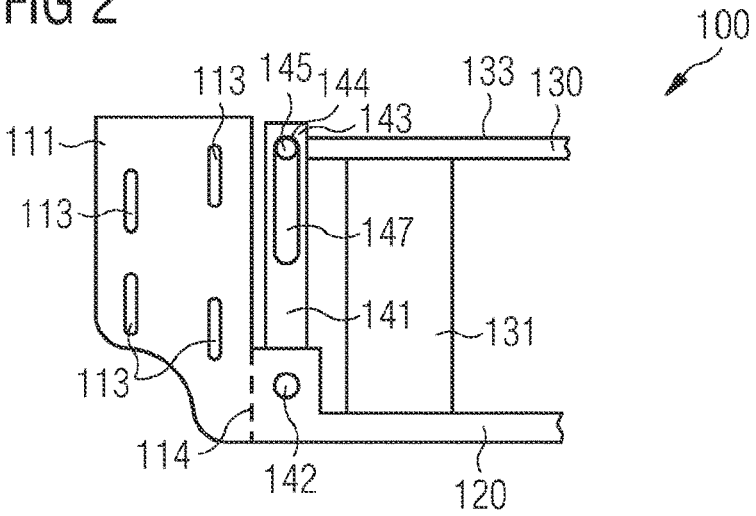
FIG. 2 is a cut-out of a coupling support having a pivot lever.

Similarly to the following Figures, FIG. 2 shows a cut-out of a plan view of a coupling support 100, in particular in the region of the first retaining plate 111 and the first pivot lever 141. In this embodiment, the first retaining plate 111 has four elongate fixing holes 113, by which a vertical position can be adjusted when the coupling support 100 is fitted to a rail vehicle. The first pivot lever 141 has in this embodiment an elongate hole 147, by which a first bolt 145 is guided. The first bolt 145 is connected to the transverse bar 130, wherein the first bolt 145 and the first elongate hole 147 together form the first articulated connection 144 between the first upper portion 143 of the first pivot lever 141 and the transverse bar 130.

Figure 3:
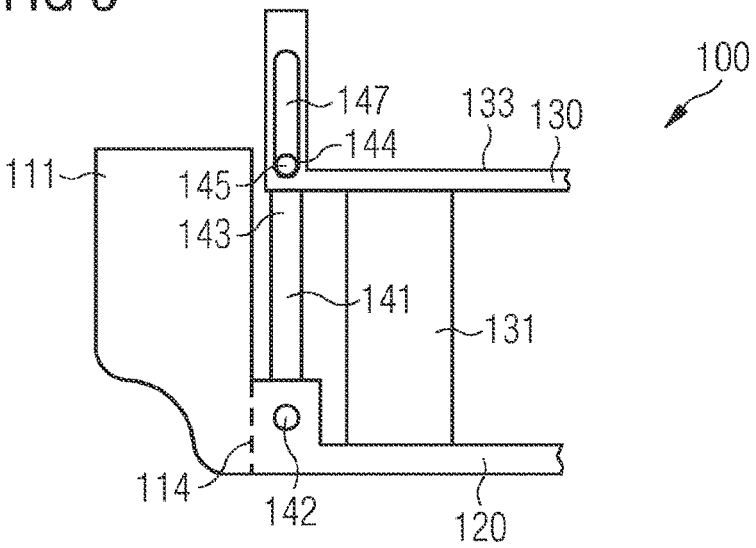
FIG. 3 shows a cut-out of a coupling support having a pivot lever.

FIG. 3 is a plan view of a coupling support 100, in which the first articulated connection 144 also comprises a first bolt 145 and a first elongate hole 147. In this case, the first elongate hole 147 is arranged on the transverse bar 130, while the first bolt 145 is arranged on the first pivot lever 141, in particular arranged on the first upper portion 143 of the first pivot lever 141. FIG. 3 does not illustrate any fixing holes 113, but they can be provided as required similarly to FIGS. 1 and 2 in the first retaining plate 111.

Both in the coupling support 100 of FIG. 2 and in the coupling support 100 of FIG. 3, the first bolt 145 and the first elongate hole 147 are configured in such a manner that a movement of the transverse bar 130 toward the base plate 120 is possible, while a movement of the transverse bar 130 away from the base plate 120 is limited as a result of the arrangement of the first bolt 145 and the first elongate hole 147. The limitation of the movement is provided in that the first bolt 145 abuts the first elongate hole 147. In this position, the transverse bar 130 is retained by the resilient element 131.

Figure 4:
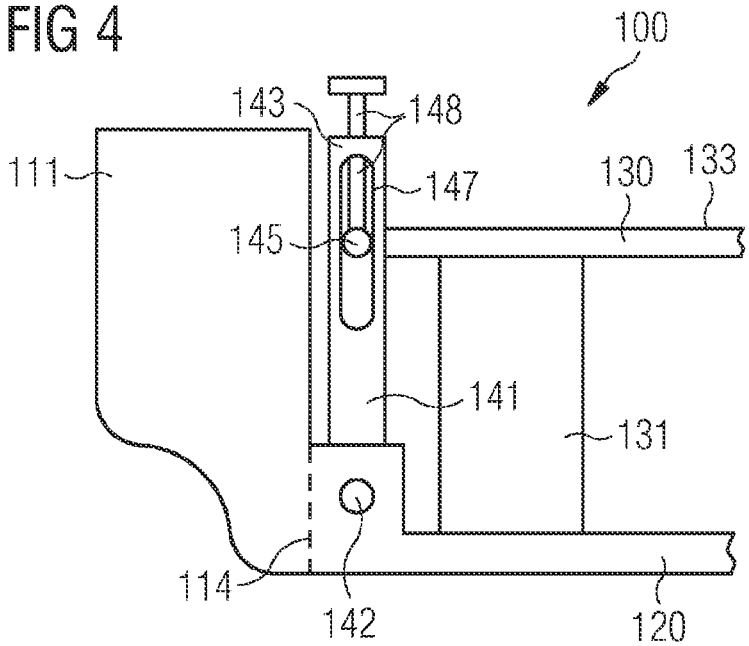
FIG. 4 shows a cut-out of a coupling support having a pivot lever.

FIG. 4 shows a cut-out of a coupling support 100 which corresponds to the coupling support 100 of FIGS. 2 and 3 unless any differences are described below. Just as in FIG. 3, no fixing holes 113 are depicted in FIG. 4 in the first retaining plate 111 but they can be provided similarly to FIGS. 1 and 2. The first bolt 145 which is connected to the transverse bar 130 is guided in the first elongate hole 147. The first upper portion 143 of the first pivot lever 141 is configured in such a manner that an adjustable vertical stop 148 can be moved along the first pivot lever 141 in such a manner that an available length of the first elongate hole 147 can be changed by the adjustable vertical stop 148. In this case, the changeable vertical stop 148 can be configured as a screw which can be screwed into or out of the first pivot lever 141 and which can thus change the available length of the first elongate hole 147. In this case, the first bolt 145 is limited in terms of its movement upward, that is to say, away from the base plate 120, by the adjustable vertical stop 148.

Figure 5:
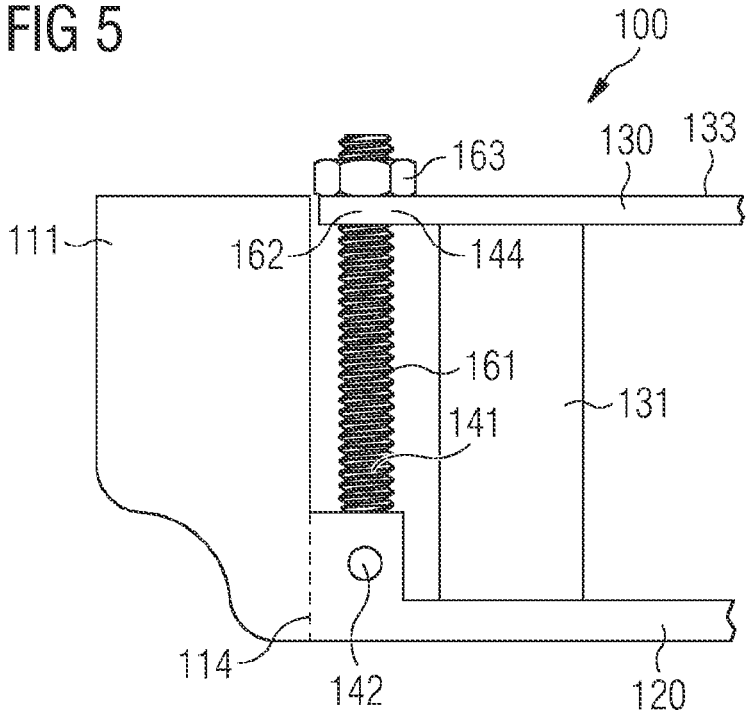
FIG. 5 shows a cut-out of a coupling support having a pivot lever.

FIG. 5 shows an additional cut-out of a coupling support 100 in the region of the first retaining plate 111 and the first pivot lever 141. The first pivot lever 141 is configured as a first threaded rod 161, wherein the first threaded rod 161 is guided by a first opening 162 of the transverse bar 130 and a first nut 163 is arranged above the transverse bar 130 in order to fix the transverse bar 130 in a specific position. The first threaded rod 161, the first opening 162 and the first nut 163 form in this case the first articulated connection 144, by means of which the transverse bar 130 can be moved. In this case, the movement of the transverse bar 130 can be carried out in such a manner that, during a movement of the transverse bar 130 toward the base plate 120, the transverse bar 130 is displaced in such a manner that the first opening 162 no longer abuts the first nut 163 but is instead arranged in a lower position (in the direction of the base plate 120) on the threaded rod 161. As a result of the first nut 163, however, the movement of the transverse bar 130 away from the base plate 120 is limited.

Figure 6:
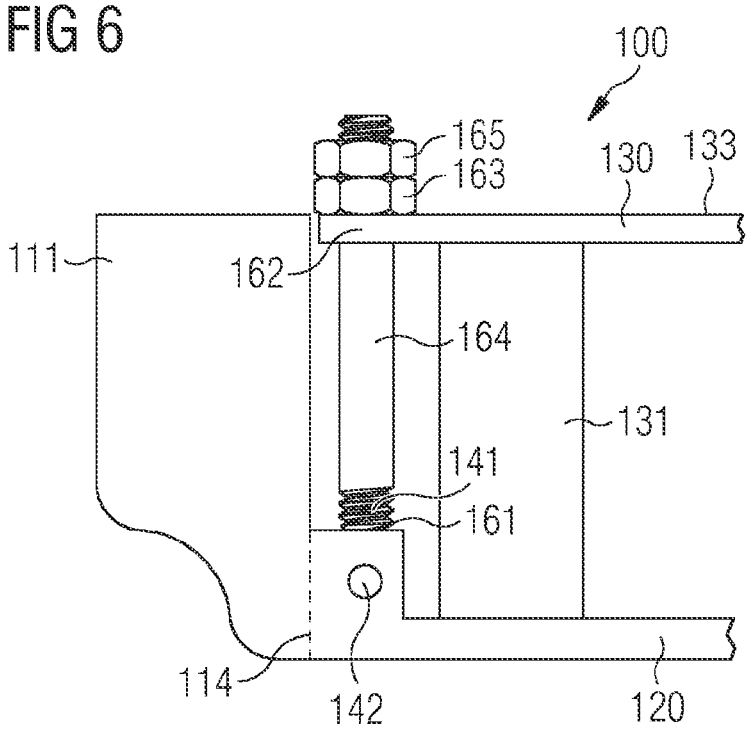
FIG. 6 shows a cut-out of a coupling support having a pivot lever.

FIG. 6 shows a cut-out of a coupling support 100 which corresponds to the coupling support 100 of FIG. 5 unless any differences are described below. The first nut 163 has a first thread protection 164. In this case, the first thread protection 164 has an internal thread which corresponds to the first threaded rod 161 and is guided by the first opening 162. A movement of the transverse bar 130 along the first threaded rod 161 thereby causes less damage to the thread of the first threaded rod 161 because the thread of the first threaded rod 161 is protected by the first thread protection 164. There is additionally illustrated in FIG. 6 an optional first counter-nut 165, with which the first nut 163 can be fixed in its position.

Figure 7:
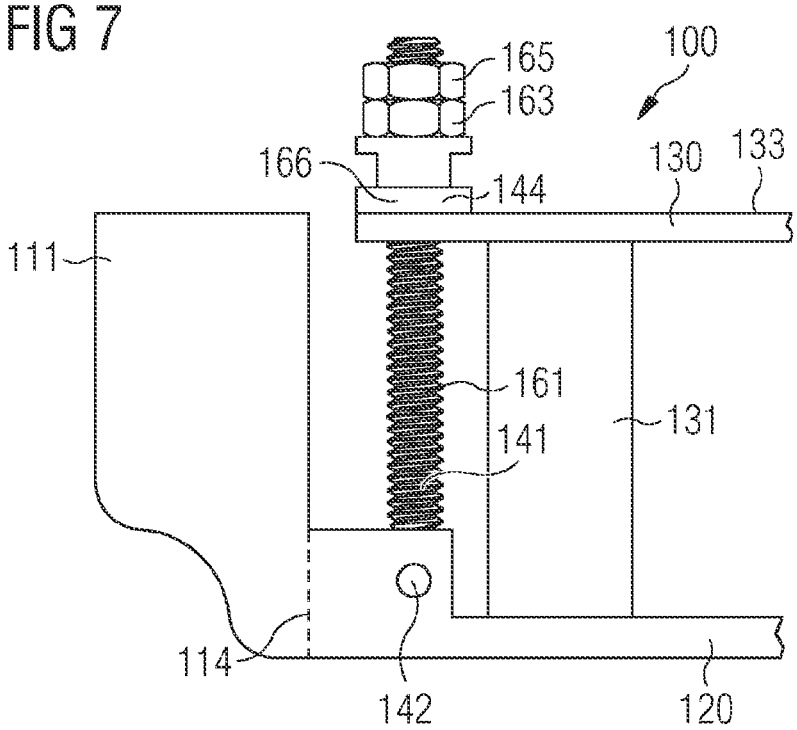
FIG. 7 shows a cut-out of a coupling support having a pivot lever.

FIG. 7 is a view of a cut-out of a coupling support, also in the region of the first retaining plate 111 and the first pivot lever 141 which corresponds to the coupling support 100 of FIG. 5 unless any differences are described below. The first articulated connection 144 is configured in this instance as a first ball joint 166. In this case, the first ball joint 166 has an inner opening which can be displaced on the first threaded rod 161. The first ball joint 166 is fixed above the transverse bar 130 on the first threaded rod 161 by means of a first nut 163. There is additionally illustrated in FIG. 7 an optional first counter-nut 165. In this case, the first ball joint 166 can be compressed with the transverse bar 130 or be fixed to the transverse bar 130 in some other manner. If the transverse bar 130 moves in the direction of the base plate 120, the first ball joint 166 moves along the first threaded rod 161. During the movement away from the base plate 120, the transverse bar 130 is limited in that at a specific location the first ball joint 166 abuts the first nut 163 and further movement beyond this location is not possible.

There may be provision in this embodiment also to provide the first nut 163 with a first thread protection 164 similarly to FIG. 6 in order to also reduce damage to the first threaded rod 161 in this embodiment.

FIGS. 2 to 7 show the first pivot lever 141 and the first retaining plate 111. The second pivot lever 151 and the second retaining plate 112 can be constructed in the coupling supports 100 of FIGS. 2 to 7 similarly to the first pivot lever 141 and the first retaining plate 111. Alternatively, there may also be provision for configuring the first pivot lever 141 similarly to one of the embodiments of FIGS. 1 to 7 and the second pivot lever 151 similarly to another embodiment of FIGS. 1 to 7.

There is also depicted in FIGS. 2 to 7 an optional desired breaking location 114, by which the crash safety of the coupling support 100 can be increased. In the event of an accident, the first retaining plate 111 can break at the desired breaking location 114, whereby it may become possible for a deformation energy to be taken up by an energy consumption element which is arranged behind the coupling support 100. The second retaining plate 112 may have such a desired breaking location 114.

Furthermore, the transverse bar 130 has in FIGS. 1 to 7 an optional sliding plate 133 which is arranged at a side of the transverse bar 130 facing away from the base plate 120. The sliding plate 133 can be used to support the coupling shaft of a central buffer coupling and may reduce the sliding friction between the coupling shaft and the transverse bar 130.

Figure 8:
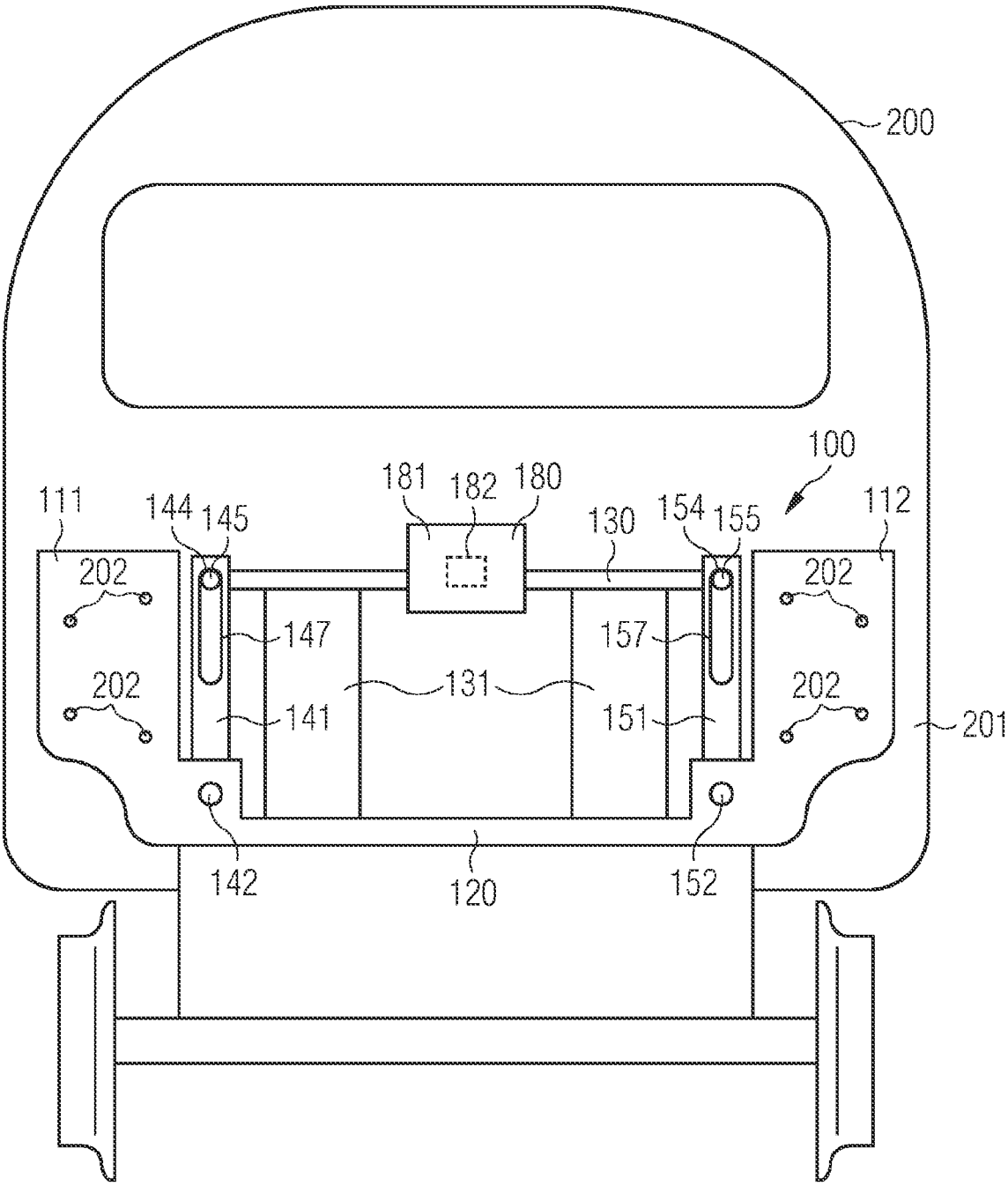
FIG. 8 is a front view of a rail vehicle.

FIG. 8 is a front view of a rail vehicle 200 with a coupling support 100 and a central buffer coupling 180. The coupling support 100 is configured in this instance similarly to the coupling support 100 of FIG. 2, but can also be configured similarly to the coupling support of FIG. 1 or FIGS. 3 to 7. The coupling support 100 is fixed to the vehicle body 201 of the rail vehicle 200 by screws 202 being guided by fixing holes of the retaining plates 111, 112 and being screwed to the vehicle body 201. In this case, the fixing holes can be configured similarly to FIG. 1. The central buffer coupling 180 has a coupling head 181 which is arranged in front of the coupling support 100 in the travel direction. Behind the coupling head 181, the central buffer coupling 180 has a coupling shaft 182 which is illustrated with broken lines and which is positioned on the transverse bar 130 of the coupling support 100. The coupling shaft 182 cannot be seen in the plan view as a result of the coupling head 181.

If the central buffer coupling 180 moves downward, that is to say, in the direction of the base plate 120, the transverse bar 130 is moved in the direction of the base plate 120, wherein the resilient elements 131 are compressed in this case. This movement is possible as a result of the articulated connections 144, 154 since the bolts 145, 155 can be moved in the elongate holes 147, 157 in this case.

Alternatively to the illustration in FIG. 8, a different number of resilient elements 131, for example, one resilient element or three or four resilient elements, can also be arranged between the base plate 120 and the transverse bar 130.

The coupling head 181 may correspond to the Janney construction type in this case. Alternatively, the coupling head 181 may be part of a UIC central buffer coupling (AK69e), a Scharfenberg coupling, an SA3 coupling, a C-AKv coupling or a different central buffer coupling construction type.

Figure 9:
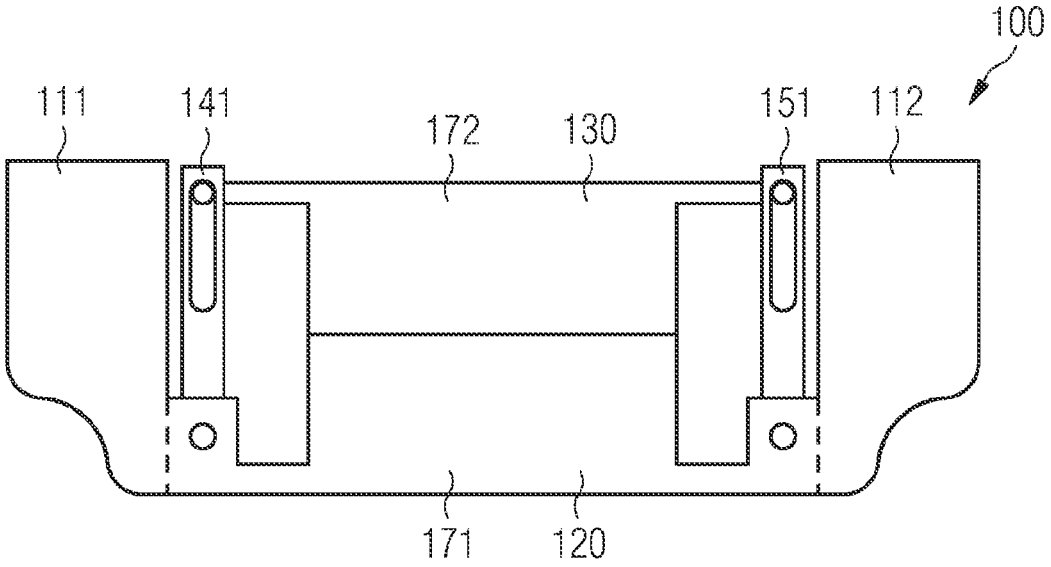
FIG. 9 shows an additional embodiment of a coupling support.

FIG. 9 is a plan view of an additional embodiment of a coupling support 100 which corresponds to the coupling support 100 of FIG. 8 unless any differences are described below. The base plate 120 is changed in this embodiment in such a manner that a lower housing portion 171 projects from the base plate 120 and partially surrounds the resilient elements 131 so that the resilient elements are no longer visible in the region of the base plate 120. The transverse bar 130 is configured in such a manner that an upper housing portion 172, extending from the transverse bar 130, engages round the lower housing portion 171 so that the resilient elements 131 are arranged completely inside the housing which comprises the lower housing portion 171 and the upper housing portion 172.

Although the invention has been illustrated and described in detail by the preferred embodiment, the invention is not limited by the disclosed examples and other variations can be derived therefrom by the person skilled in the art without departing from the scope of protection of the invention.

The invention claimed is:

1. A coupling support to be fixed to a vehicle body of a rail vehicle for supporting a central buffer coupling of the rail vehicle, the coupling support comprising:

first and second retaining plates to be fixed to the vehicle body of the rail vehicle;

a base plate disposed between said first and second retaining plates;

a transverse bar disposed between said retaining plates, said transverse bar being resiliently coupled to said base plate and disposed above said base plate;

first and second pivot levers disposed on said base plate, said first pivot lever having a first pivot location disposed under said transverse bar, said second pivot lever having a second pivot location disposed under said transverse bar, said first and second pivot locations being connected to said base plate, said first pivot lever having a first upper portion and said second pivot lever having a second upper portion;

first and second articulated connections each forming a vertical stop of said transverse bar, said first articulated connection connecting said first upper portion to said transverse bar and said second articulated connection connecting said second upper portion to said transverse bar, said articulated connections limiting a movement of said transverse bar away from said base plate and said articulated connections permitting a movement of said transverse bar toward said base plate;

said first articulated connection having a first bolt disposed on said transverse bar, said first bolt being guided in a first elongate hole formed in said first pivot lever; and said first pivot lever having an adjustable vertical stop for changing an available length of said first elongate hole.

2. The coupling support according to claim 1, which further comprises a resilient element disposed between said base plate and said transverse bar.

3. The coupling support according to claim 2, wherein said resilient element is relaxed by said movement of said transverse bar away from said base plate, and said resilient element is tensioned by said movement of said transverse bar toward said base plate.

4. A central buffer coupling, comprising:

a coupling support according to claim 1;

a coupling shaft supported by said transverse bar of said coupling support; and a coupling head disposed on said coupling shaft.

5. A rail vehicle, comprising:

a coupling support according to claim 1;

said coupling support being fixed to the rail vehicle by said retaining plates.

6. The rail vehicle according to claim 5, which further comprises a central buffer coupling having a coupling shaft and a coupling head disposed on said coupling shaft, said coupling shaft being supported by said transverse bar of said coupling support.

* * * * *